US007625482B1

(12) United States Patent
Hunt et al.

(10) Patent No.: US 7,625,482 B1
(45) Date of Patent: Dec. 1, 2009

(54) NANOPARTICULATE-CATALYZED OXYGEN TRANSFER PROCESSES

(75) Inventors: Andrew T. Hunt, Atlanta, GA (US); Richard C. Breitkopf, Dunwoody, GA (US)

(73) Assignee: nGimat Co., Atlanta, GA (US)

( * ) Notice: Subject to any disclaimer, the term of this patent is extended or adjusted under 35 U.S.C. 154(b) by 415 days.

(21) Appl. No.: 11/473,463

(22) Filed: Jun. 23, 2006

(51) Int. Cl.
*C10G 17/00* (2006.01)

(52) U.S. Cl. ..... 208/208 R; 208/133; 208/134; 208/137; 208/213; 208/216 PP; 208/216 R; 208/217; 585/400; 585/402; 585/407; 585/419; 585/500; 502/38; 502/51; 502/52

(58) Field of Classification Search ..... 208/133, 208/134, 137, 138, 208 R, 213, 217, 216 PP, 208/216 R; 502/38, 51, 52; 585/400, 402, 585/407, 410, 500, 419
See application file for complete search history.

(56) References Cited

U.S. PATENT DOCUMENTS

| | | | | |
|---|---|---|---|---|
| 5,235,121 | A * | 8/1993 | Brinkmeyer et al. | 585/402 |
| 5,837,642 | A | 11/1998 | Tanaka et al. | |
| 5,997,956 | A | 12/1999 | Hunt et al. | |
| 6,270,835 | B1 | 8/2001 | Hunt et al. | |
| 6,752,979 | B1 | 6/2004 | Talbot et al. | |
| 6,881,384 | B1 | 4/2005 | Uenishi et al. | |

FOREIGN PATENT DOCUMENTS

| | | | |
|---|---|---|---|
| DE | 198 05 259 | A1 | 8/1998 |
| GB | 802 559 | | 10/1958 |
| WO | WO 00/16899 | | 3/2000 |
| WO | WO 02/053492 | A1 | 11/2002 |

* cited by examiner

*Primary Examiner*—In Suk Bullock
*Assistant Examiner*—Prem C. Singh

(57) ABSTRACT

Nanoparticulates of oxygen transfer materials that are oxides of rare earth metals, combinations of rare earth metals, and combinations of transition metals and rare earth metals are used as catalysts in a variety of processes. Unexpectedly large thermal efficiencies are achieved relative to micron sized particulates. Processes that use these catalysts are exemplified in a multistage reactor. The exemplified reactor cracks C6 to C20 hydrocarbons, desulfurizes the hydrocarbon stream and reforms the hydrocarbons in the stream to produce hydrogen. In a first reactor stage the steam and hydrocarbon are passed through particulate mixed rare earth metal oxide to crack larger hydrocarbon molecules. In a second stage, the steam and hydrocarbon are passed through particulate material that desulfurizes the hydrocarbon. In a third stage, the hydrocarbon and steam are passed through a heated, mixed transition metal/rare earth metal oxide to reform the lower hydrocarbons and thereby produce hydrogen. Stages can be alone or combined. Parallel reactors can provide continuous reactant flow. Each of the processes can be carried out individually.

5 Claims, 3 Drawing Sheets

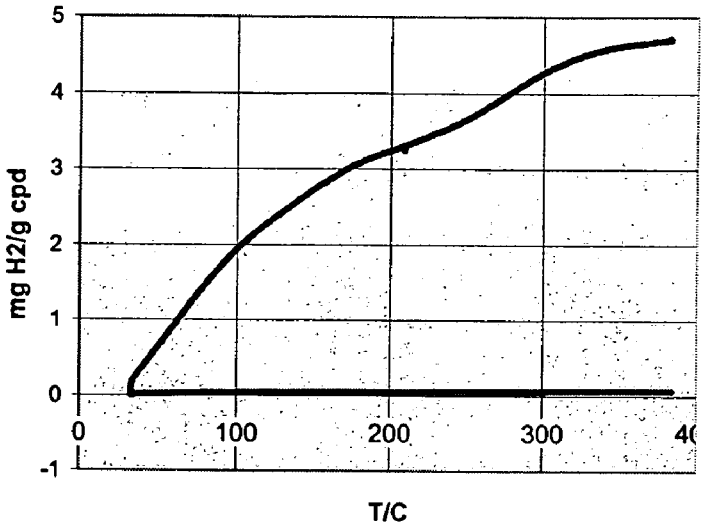
FIG. 1
FIG. 2
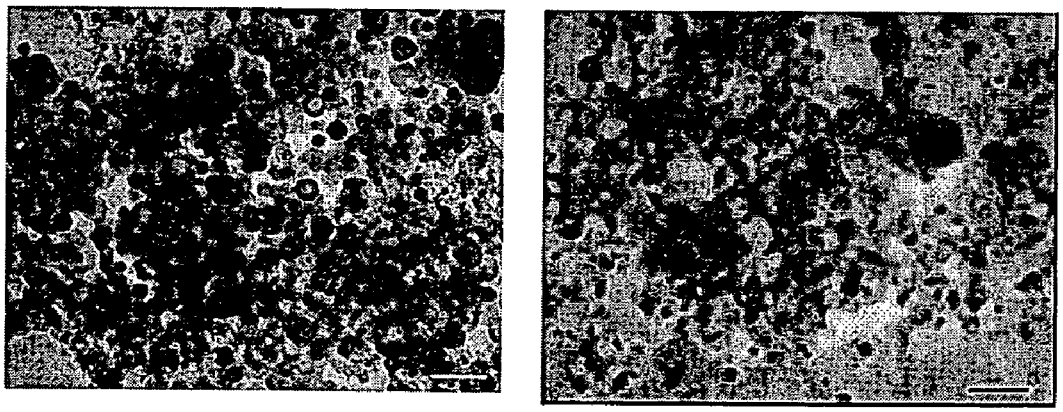

NANOPARTICULATE-CATALYZED OXYGEN TRANSFER PROCESSES

This invention was made with US Government support under contracts DE-FG02-04ER86219 and FA8501-05-M-0133 awarded by the Department of Energy and the Air Force, respectively. The US Government has certain non-transferable rights in the invention.

The present invention is directed to processes that use oxygen transfer nanoparticulate-based materials. One aspect of the invention is directed to methods and apparatus for reforming hydrocarbons, including relatively high molecular weight hydrocarbons, to obtain hydrogen gas that may be used, for example, in fuel cells. The invention is also directed toward materials and processes capable of reforming both natural gas and jet fuel at temperatures below 650° C., and further to the reduction and removal of sulfur-bearing compounds in petroleum fluids.

BACKGROUND OF THE INVENTION

The process in this invention utilizes sorbents and catalysts that are generally of fluorite-type structure. The fluorite-type crystalline structure of the oxides used in the present invention is based on the fundamental $CaF_2$ unit, in which the cation(s) has a face-centered-cubic (fcc) lattice, while the oxygen forms a cube case encapsulated inside the fcc lattice. The cation is or includes a rare earth metal, such as cerium, that creates "oxygen deficiencies" in the lattice by valance change, e.g. from 4+ to 3+. This typical structure has a unique advantage of creating a high percentage of oxygen vacancies without reconstructional phase transition in the cation sublattice even at temperatures higher than 1000° C., which is fundamental to the large oxygen transfer capacity of the oxides. The oxygen sublattice is independent, and the migration of an oxide ion does not require a substantial cooperative movement of any cation, because the valence variation of the rare earth (RE) cation, e.g., cerium cation, between valence 4+ and 3+ can easily accommodate oxygen vacancies. $REO_2$ can be reduced reversibly to $REO_{1.714}$, giving a large percentage release of oxygen.

One process to which the invention is directed is reforming of hydrocarbons to form hydrogen gas, and more particularly to producing hydrogen gas fractions that are sufficiently free of CO that they can be used in proton exchange membrane (PEM) fuel cells with little or no further purification. Traditional single step steam reforming is generally carried out at very elevated temperatures, typically ranging from 800° C. to 1700° C. These temperatures are required to effect good hydrogen production yields. Such elevated temperatures require very substantial energy input, reducing the overall efficiency of hydrogen production. Additionally, a reformer reactor will produce an initial syngas with carbon monoxide levels in excess of 20% by volume which requires further downstream processing that initially brings this down below 1% (water gas shift) followed by additional shift reaction and membrane purification to bring this impurity level below 30 ppm required for hydrogen that is to be used in conjunction with proton exchange membrane (PEM) technologies. If carbon monoxide levels exceed 30 ppm, the anode catalyst in the PEM fuel cell, which is often comprised of a platinum-based material, will be poisoned and will rapidly lose hydrogen oxidation activity. Additionally, if diesel fuel or heavy hydrocarbons are used as the fuel source, separate desulfurization steps are also required. This is because sulfur-bearing species generally poison Pt cathode and anode electrocatalyst materials in a PEM fuel cell. For this reason, many reforming catalysts must operate at 900° C. or higher so that sulfur may be completely removed from the catalyst surface. This increases energy costs and makes the use of nanomaterials difficult due to the high likelihood of sintering active materials at these temperatures. It is one general object of the present invention to reduce the energy demands of hydrogen production from hydrocarbons and to reduce subsequent purification steps that hinder production throughput.

Additionally, if diesel fuel or heavy hydrocarbons are used as the fuel source, separate desulfurization steps are also required. This is because sulfur-bearing species generally poison Pt-based electrocatalyst materials in a PEM fuel cell. One oxygen transfer process of the present invention is desulfurization of petroleum fuels containing high amounts of sulfur-bearing chemical species.

Most commonly in steam reforming, gas phase hydrocarbon with methane is the hydrocarbon of choice as the hydrogen source. It is desirable in some instances that efficient hydrogen production can be obtained from higher weight hydrocarbons, e.g., C6-C20 hydrocarbon mixtures. One particular aspect of the present invention is directed to a reactor that can efficiently produce hydrogen gas, substantially free of carbon monoxide, from a range of hydrocarbons including heavy fuels such as jet fuel, generally considered to have the average empirical formula $C_{11}H_{21}$. Heavier hydrocarbons are difficult to vaporize and decompose into smaller hydrocarbon fragments, making reforming difficult at temperatures below 900° C. (in addition to the reasons associated with sulfur tolerance described above). Herein are described systems and methods for effecting such "cracking" below 650° C. and reforming the resulting lower hydrocarbon downstream in a subsequent step in the same reactor. High yield conversions at temperatures of 650° C. or well below are made possible by the catalyst materials of the present invention.

C6-C20 fuels frequently contain significant levels of sulfur-bearing compounds, and it is a further object of the invention to produce hydrogen gas with not only very low carbon monoxide levels, but also low sulfur-containing impurities. One aspect of the invention is directed to a method for desulfurization (reduction or elimination of sulfur-containing compounds) of petroleum fluids. Catalyst materials in accordance with the invention are useful in desulfurization of petroleum fluids.

One aspect of the invention is use of oxygen transfer catalyst material to crack, desulfurize and reform C6-C20 hydrocarbons to produce PEM-grade or near PEM-grade hydrogen in a continuous process. The continuous process is conveniently performed in a flow-through reactor. This aspect of the invention addresses a specific requirement of military units that frequently are supplied with significant amounts of jet fuel. It is contemplated that isolated military units may use hydrogen gas, produced at a relatively proximal facility, in portable fuel cells for electrical generation and replacement of batteries. Hydrogen gas used in fuel cells produces a lower detectable signature of local energy generation than do combustion methods.

While it is one general object of the invention to provide an apparatus that will efficiently generate hydrogen gas from C6-C20 hydrocarbon mixtures, it is understood that such a reactor will also efficiently produce hydrogen from lower molecular weight hydrocarbons, including C1-C5 hydrocarbons. For example, the catalysts of the present invention produce hydrogen from methane at substantially lower temperatures than was heretofore possible or efficient.

Catalyst materials in accordance with the invention are useful in both a one-step method and a two-step method to prepare very pure hydrogen (low CO and S-bearing species levels) at low temperatures (650° C. or below). The one-step initial reforming reaction is described in equation (I) below:

$$C_xH_y+H_2O(cat)\rightarrow xCO+(y/2+1)H_2 \quad (I)$$

In equation (I), carbon monoxide is generated and comprises 1-50 vol % of the effluent stream. Carbon monoxide, which must be removed from a PEM fuel cell stream, is generally treated in a separate water gas shift reactor downstream. In the current invention, carbon monoxide is either drastically reduced in a single reactor by adding additional catalyst of formula $M(1)_xM(2)_{1-x}O_{2-z}$ where M(1) is a transition metal (preferably a first row transition metal), M(2) is a rare earth metal, x is between about 0.01 and about 0.9, and z represents a degree of oxygen deficiency in said catalyst relative to M(1) plus M(2). This allows in situ water gas shift reactions to take place according to equation (II):

$$CO+H_2O(cat)\rightarrow CO_2+H_2 \quad (II)$$

Alternatively, a pure hydrogen product may be generated from these same catalysts at low temperature (650° C. or below) according to equations (III) and (IV):

$$xC_aH_b+M(1)_wM(2)_{1-w}O_{2-z}\rightarrow axCO+xb/2H_2+M(1)_wM(2)_{1-w}O_{2-z-xa} \quad (III)$$

$$M(1)_wM(2)_{1-w}O_{2-z-xa}+xaH_2O\rightarrow xaH_2+M(1)_wM(2)_{1-w}O_{2-z} \quad (IV)$$

In the first step (III), a syngas consisting of hydrogen and carbon monoxide is generated at temperatures below 650° C. which allows sequestration of the carbon monoxide impurity exclusively in this stream. Because the mixed oxide is reduced in this step and oxygen vacancies are created, reaction (IV) can take place in which these vacancies are replenished using oxygen from the water, generating hydrogen in the process.

In order to reduce reforming temperatures, nanoparticulate catalyst materials are used in this invention in place of those with micron-sized grains. These include transition metal-substituted and rare earth metal-substituted rare earth fluorites of formula: $M(1)_xM(2)_{1-x}O_{2-z}$ as described above in respect to reactions (III) and (IV). In the invention, reforming and "cracking" processes, associated with reactions I-IV are enabled at temperatures at or below 650° C. using materials with surface area at least 15 $m^2/g$, preferably with surface area greater than 50 $m^2/g$. The use of the nanopowder in a reforming, cracking, or water gas shift reaction has shown enormous activity enhancements at temperatures below 650° C., even as low as 200° C. when compared to micron-sized powders with the same compositions (R. Pati et al, 41st *Power Sources Conference*, pp. 227-230, 14-17 Jun. 2004). While Applicants are not bound by theory, it appears that the increased surface area allows enhanced oxygen vacancy formation kinetics at these lower temperatures and thus enables reforming, shift and hydrocarbon "cracking" reactions. It is not clear whether this enhancement is the result of increased reaction rate from enhanced surface area alone, or whether there is an accompanying intrinsic surface chemistry change associated with higher surface energies or chemical functionalities.

SUMMARY OF THE INVENTION

The invention is directed to processes, including petroleum reforming, petroleum fluid desulfurization, and hydrocarbon reforming, that produce hydrogen gas using oxygen transfer catalysts. These catalysts have the general chemical formula:

$$M(1)_xM(2)_{1-x}O_{2-z} \quad (A)$$

where M(1) is a transition metal or a rare earth metal, M(2) is a rare earth metal, x is between 0 and about 0.9, and z represents a degree of oxygen deficiency in said catalyst relative to M(1) plus M(2). The particulates have surface areas of at least about 15 $m^2/gm$, preferably at least about 25 $m^2/gm$, and more preferably even higher surfaces, such as 50 $m^2/gm$. In formula (A) above, it is to be understood that both M(1) and M(2) may be mixtures of appropriate metals.

The nanoparticulate (sub-micron) catalyst materials used in the process of the present invention achieve results that far exceed what might be expected merely from the increased surface areas of nanoparticulates as opposed to micron and above sized particulates.

In accordance with one aspect of the invention, hydrocarbon cracking, desulfurization, and reforming are carried out in a continuous process. To this end, a reactor is provided into which is introduced water and hydrocarbon that is either in vaporized form or in the form of extremely fine droplets, i.e., preferably micron or sub-micron droplets (1 micron or lower). The reactor contains at least three reaction stages, each stage containing (mean particle diameter) sub-micron particulates of specific catalysts or sorbents.

Alternatively, a reactor may be comprised of a single stage that contains reformate catalyst nanomaterial that is used exclusively for two-step reforming of hydrocarbons into hydrogen described in equations (III) and (IV) above. In this embodiment, the hydrocarbon is reacted over the catalyst in a first step at temperatures ranging from 300 to 650° C. to form a reduced, oxygen-deficient material and gaseous carbon oxides, water and hydrogen. Water vapor is then passed over the reduced catalyst prepared in the first step to form pure hydrogen. Optionally, the gas from the first step can be burned to supply heat, which may enable autothermal conditions, and the pure hydrogen stream is used for the required high purity application such as chemical processing or fuel cells. To make the process continuous, two or more reactors in tandem would be used, in which one would be used to perform the first step while the other would be used in the second step to produce pure hydrogen.

IN THE DRAWINGS

FIG. 1 shows thermogravimetric analysis (TGA) traces comparing oxygen weight loss at elevated temperatures in the presence of methane fuel of micron-sized catalyst material (lower trace) as compared to nanoparticulate catalyst material (upper trace).

FIG. 2 shows comparative TEM images of $Cu_xCe_{1-x}O_2$ nanocatalyst both before and after reforming showing excellent retention of spherical particle size on the order of 20-30 nm.

DETAILED DESCRIPTION OF CERTAIN PREFERRED EMBODIMENTS

While processes described herein have been performed previously using particulate material of micron size or above, herein, nanoparticulate oxygen transfer catalysts are found to enhance performance, particularly with respect to lowering of reaction temperature than would be expected from increased surface area alone. The use of nanoparticulates is one of the key factors in Applicants' ability to obtain hydrogen at lower reactor temperatures than previously reported. The only limitations on reduction of particulate size are the ability to produce finer particulates and the need to avoid grain growth resulting from reactions at elevated temperatures. Thus, it is important that certain temperatures are not exceeded over certain lengths of time. Of course, permeability through catalyst bed particulates is important; the reactor stages must allow for sufficient fuel flow through the reactor and have a fairly uniform flow field such that the reactants flow along and contact much of the nanomaterial.

FIG. 1 shows thermogravimetric analysis (TGA) traces comparing oxygen weight loss at elevated temperatures in the presence of methane fuel. Here can be seen a dramatic difference between oxygen vacancy creation capacity in the nanomaterial (100-150 $m^2/g$ specific surface area) and the currently used micron-sized compound (<1 $m^2/g$). Oxygen vacancy creation is translated into mg $H_2/g$ cpd (2-5) using equation (I). At temperatures as low as 400° C., the nanomaterial has nearly 50 times more oxygen vacancy creation than is observed for the micron-sized species. Because this reaction is carried out with the nanomaterial at lower temperatures, it may be concluded that both the enhanced surface area and surface energy associated with the nanomaterial is enhancing syngas production and/or steam reforming kinetics permitting excellent reaction rates well below 650° C. In addition, the rare earth metals comprising the parent oxide structure formula (A) may provide additional temperature lowering of the onset of oxygen vacancy creation.

The graph of FIG. 1 is based on M(1) being copper and M(2) being cerium. Pr, Sm, or Th, if used in place of Ce as M(2), are better suited to accommodate a +3 oxidation state than Ce, thus making vacancy creation even more thermodynamically and kinetically feasible.

FIG. 2 shows comparative TEM images of $Cu_xCe_{1-x}O_2$ nanocatalyst both before and after reforming showing excellent retention of spherical particulate size on the order of 20-30 nm.

Figure 3:
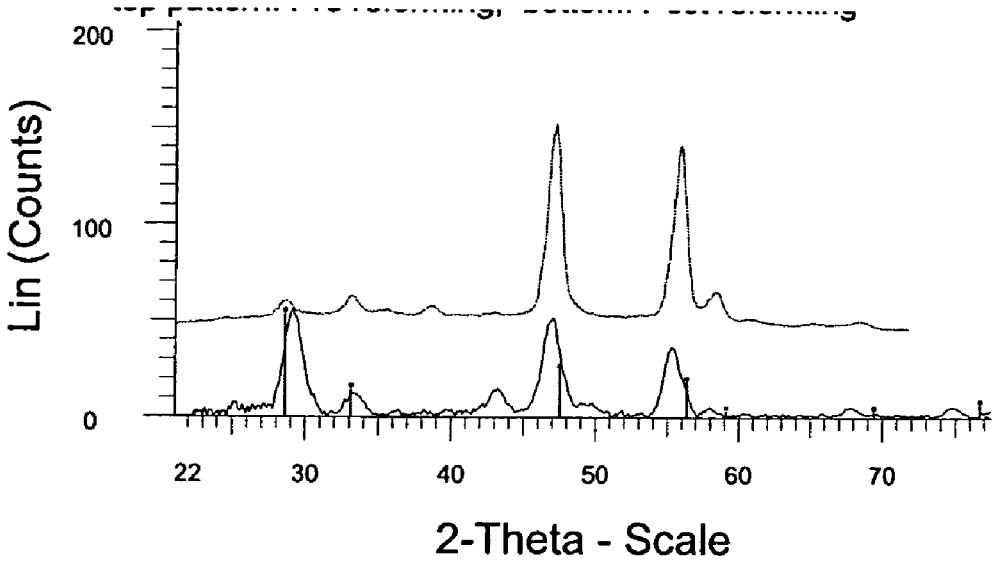
FIG. 3 shows X-ray diffraction patterns comparing the nanomaterial both before (upper trace) and after (lower trace) reforming, the different traces indicating the disappearance of an initial copper oxide phase (2-theta~33°) and appearance of a nanocrystalline metallic copper phase (2-theta~43°) under reducing conditions.

FIG. 3 shows X-ray diffraction patterns comparing the nanomaterial of FIG. 2 both before (upper trace) and after (lower trace) reforming, indicating the disappearance of an initial copper oxide phase (2-theta~33°) and the appearance of a nanocrystalline metallic copper phase (2-theta~43°) under reducing conditions. The formation of these nano-sized domains not only gives a high surface area catalytic surface allowing low temperature reforming to take place but also provides a metal-oxide interface facilitating oxygen transfer from the fluorite. In catalysts of formula (A) containing both a transition metal, such as copper, and a rare earth metal, such as cerium, the transition metal may at least in part segregate from the rare earth metal, thereby creating a composite that has sub-micron or nanosized crystal structure. Catalytic materials exhibiting such segregation continue to efficiently function through multiple cycling.

Figure 4:
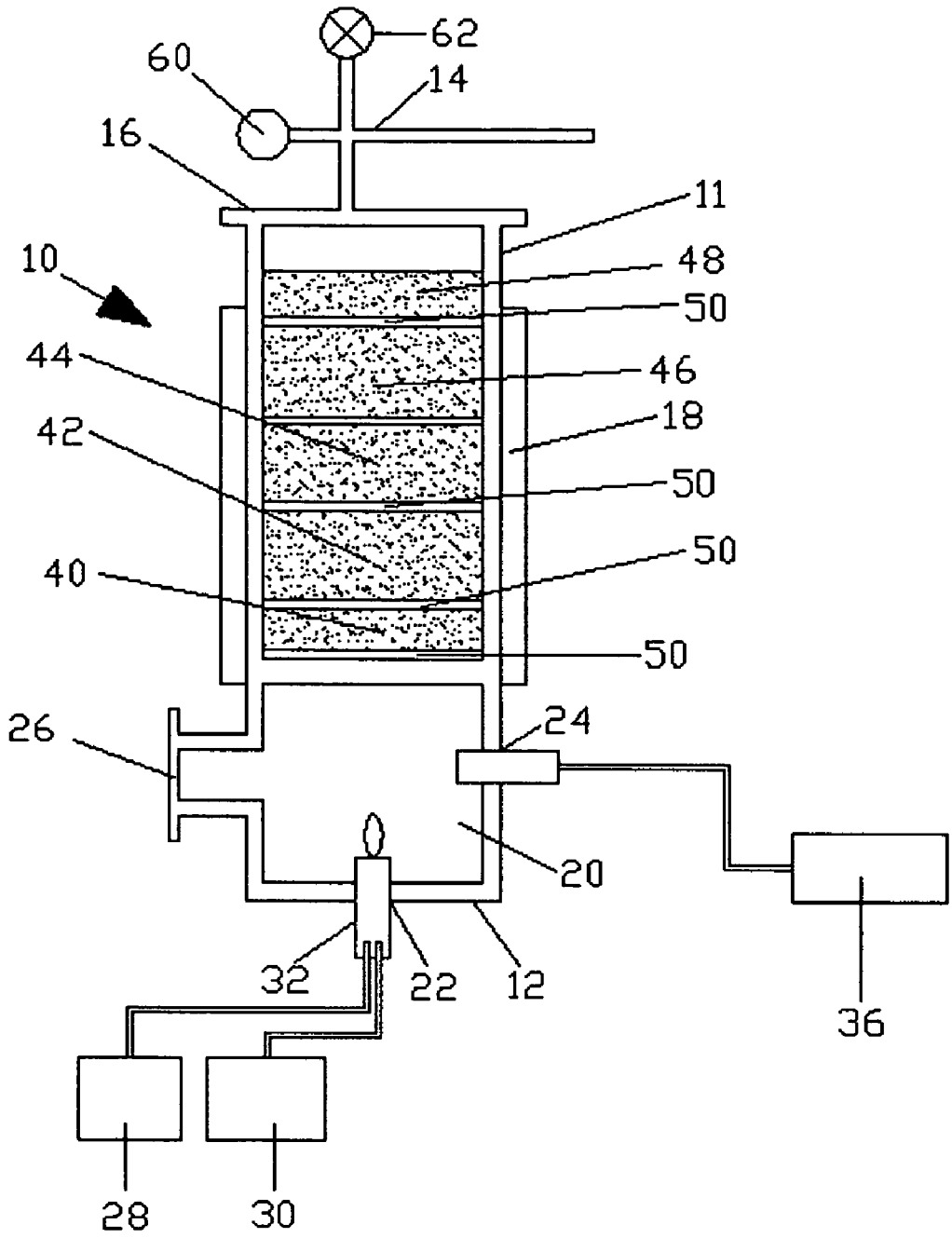
FIG. 4 is a diagrammatic illustration of a currently preferred embodiment of a reactor for carrying out multiple catalytic processes in accordance with the invention.

Specific reaction processes facilitated by the nanoparticulate catalyst materials of the present invention are described in more detail below in reference to a multi-stage reactor described in reference to FIG. 4. Illustrated in FIG. 4 is a reactor 10 in which hydrocarbons are cracked, desulfurized, and reformed to produce hydrogen gas. The reactor 10 shown is of generally cylindrical housing 11 design. Fluids and gases are introduced at the lower end 12 of the reactor 10 and flow upward to an exit conduit 14 at the upper end 16 of the reactor. Surrounding the housing 11 is a heating jacket 18 by which the temperatures of the reaction stages are maintained.

A lower plenum area 20 of the reactor is accessed by a fuel introduction port 22, a steam introduction port 24 and a (optional) view port 26. Fuel from source 28 and (in some cases) oxidant, e.g., oxygen, from source 30 are introduced via an atomizer 32 extending through the fuel introduction port 22. The atomizer 32 atomizes the fuel into micron or sub-micron droplets if the fuel is initially in liquid form, as is the case with jet fuel, such that the input material can readily be vaporized. The reactor may be operated with the fuel introduced in vapor and/or finely atomized liquid form without the introduction of oxygen from source 30. However, in some cases lower levels of CO may result if oxygen is introduced at very low levels so as to result in a highly fuel rich flame exiting the atomizer 32, and the heat produced from this partial burn helps create a autothermal reactor. If oxygen is introduced, it is generally at an oxygen-to-carbon stoichiometric ratio of between about 0.1 and about 0.5.

Heated water from source 36 is introduced as steam through the steam inlet port 24. The stoichiometric ratio of steam to carbon is between 2 and 5.

The mixture of steam and hydrocarbon pass upward through the stages of the reactor 10. The illustrated reactor 10 has four stages, a first cracking stage 40, a second pre-desulfurization stage 42, a third hydrogen-generating stage 44, and a post-desulfurization stage 46. Each of the stages 40, 42, 44, 46 contains high surface area rare earth oxide-containing catalytic material of formula (A) as described above, although for each stage the requirements of M(1), M(2) and x are different. An exit region 48 contains ceramic beads to weigh down the particulate material in the stages below. Each of the stage regions, 40, 42, 44, 46 and 48 is defined by layers of ceramic fabric 50 that allow gas passage through the reactor but maintain well-defined reaction stages of particulate material.

The exit conduit 14 leads to collection apparatus that may include further gas purification apparatus, e.g., to further reduce CO levels. Associated with the illustrated exit port are a pressure gauge 60 and a sampling port 62 through which gas specimens may be analyzed, e.g., by gas chromatography and mass spectrometry.

The first (cracking) stage 40 contains micron or sub-micron particulates of nanoparticulate catalyst material of general formula (A) where M(1) and M(2) are two different rare earth metals and x is between about 0.01 and about 0.9, preferably between 0.1 and about 0.9. In the first stage, higher molecular weight hydrocarbons are cracked into lower molecular weight units. At the same time, sulfur-containing species in the hydrocarbon mixture are converted to sulfur species such as sulfur dioxide and hydrogen sulfide.

In the first stage 40, the particulates preferably provide a surface area of at least 15 $m^2/gm$, more preferably at least 50 $m^2/gm$. Nanoparticulates having surface areas exceeding 100 $m^2/gm$ can be useful in reducing reaction temperature further but great care must be taken to avoid loss of surface area through sintering of particulates, which often happens at higher processing temperatures. Surface areas referred herein are measured by BET (Brunell, Emmett and Teller) measurement. This first stage 40 is aimed at "cracking" heavier hydrocarbons into lighter ones; mixed rare earth fluorites and acid functionalized group IV metal oxides with rare earths are used.

As noted above, the first stage 40 contains a mixed rare earth (RE) oxide cracking agent of general formula (A) where M(1) and M(2) are two different rare earth metals, x is between about 0.01 and about 0.9, preferably between 0.1 and 0.9. The rare earths M(1) and M(2) in this formula are selected from the group consisting of cerium, samarium, gadolinium, terbium, praseodymium, and dysprosium. In the currently preferred first stage catalyst, M(1) is Sm, M(2) is Ce, and x is between about 0.1 and about 0.6, preferably about 0.2.

The first cracking stage 40 of the reactor is maintained at temperatures between about 200° C. and 650° C. For reaction efficiency, temperatures of at least about 300° C. are preferred, more preferably at least about 500° C. However, where agglomeration of particulates is considered undesirable, it is preferred to keep the temperature at this stage, as well as the other stages described herein, at temperature of about 500° C. or below, preferably 400° C. or below.

The second reactor stage 42 contains micron and submicron particulates of a desulfurizing fluorite of formula (A). For desulfurization, x in formula (A) is typically 0, but may be above 0.01 or even above 0.1. The reactions that occur in this stage are complex, but in this stage a very significant percentage of the hydrogen sulfide is incorporated into the M(2) sorbent as a sulfide or oxysulfide that remains in this stage in solid form. Sulfur oxides formed in the first stage reacts with the fluorite to form the hydroxides or oxygen and elemental sulfur.

In the second stage 42, the nanoparticulates provide a surface area of at least 15 $m^2$/gm, preferably at least 25 $m^2$/gm, more preferably 50 $m^2$/gm, and even more preferably at least 75 $m^2$/gm, and even more preferably 100 $m^2$/gm. Once the sorbents have reached sulfidation capacity, the material must be oxidized with either air or sulfur oxides being released. Care must be taken when passing the oxidizing gasses as this step is exothermic. If care is not taken in this step, high temperatures can be obtained that result in possible grain growth, whereupon the material performance is degraded or no longer effective in future processing cycles at the desired temperatures.

The rare earth M(2) of the second stage oxide (and fourth stage oxide) for sulfur control is selected from the group consisting of cerium and gadolinium. The currently preferred second stage oxide (and fourth stage oxide) is $CeO_2$. It has been found that when in high surface area crystalline form the rare earth oxide can treat many forms of sulfur-bearing species at temperatures of 500° C. and below and in many cases even as low as 200° C., but preferably at least 300° C. to yield a significantly reduced sulfur containing fluid. Temperatures above 500° C. yield higher sulfur-removal efficiencies than lower temperatures. It is preferred to keep temperatures at this stage at 650° C. or below, however, because of exothermic reactions, temperatures in this stage may reach 700° C. Again, where particulate agglomeration is considered to be particularly undesirable, it is advantageous to maintain the temperature in this stage at 500° C. and below, preferably C400° C. or below.

The third stage 44 likewise utilizes nanoparticulates of a transition metal-substituted rare earth fluorite of formula (A). In this third stage 44, steam reforming of lower hydrocarbons and water gas shift reactions with carbon monoxide are both occurring, generating hydrogen in both reactions. Surprisingly, the gas exiting the reactor 10 contains levels of CO of 5000 ppm or less. Applicants are not bound by theory as to why this occurs, but water gas shift reactions may convert significant amounts of the CO produced in reaction (I) to carbon dioxide; alternatively, elemental carbon may also form as deposits in the stage three material. In fact, carbonaceous nanotubes are observed on the catalyst when analyzed by TEM (transmission electron microscopy)/electron diffraction analysis. These data, combined with low levels of $CO_2$ measured, indicate that catalytic conversion of hydrocarbons to hydrogen gas and carbon is taking place. The reactions in this stage are carried out at temperatures between about 200° C. and 650° C., typically at least about 300° C., and preferably at about 500° C. to 650° C. for reaction efficiency. Particulate agglomeration is minimized when this stage is maintained at 500° C. or below, preferably 400° C. or below. The carbon can then be removed by oxidation with the sulfur bearing species, and then the reactor is ready for another cycle.

In the third stage, the particulates preferably provide a surface area of at least 15 $m^2$/gm, more preferably at least 25 $m^2$/gm, and functions well above 50 $m^2$/gm. The particulates may be small enough to provide a surface area of 150 $m^2$/gm, but such a small size results in materials that readily grow to reduced surface areas where the performance is changed.

For the reforming third stage 44, in the catalyst of formula (A), M(1) is a transition metal, preferably a first row transition metal, x is ideally between about 0.1 and about 0.6 M(1) is preferably selected from the group consisting of copper, nickel and iron; M(2) is selected from the group consisting of cerium, praseodymium, samarium and gadolinium. Currently preferred transition metals are copper and iron; copper is currently the most preferred. The preferred rare earth for this stage is cerium.

The third reforming stage 44 of the reactor is maintained at temperatures between about 300° C. and about 650° C., preferably between about 400° C. and about 600° C.

Should the hydrocarbon fuel contain high levels of sulfur-bearing compounds, it may be preferable to add a fourth stage of desulfurizing fluorite similar to that of the second stage. Additional stages of transition metal substituted rare-earth fluorite, similar to stage three, may also be included.

When hydrocarbon and steam are passed through the multistage reactor, hydrogen is produced having low levels of sulfur (<1 ppm $H_2S$) and low levels of CO, i.e., about 5000 ppm CO or less. As previously noted, elemental carbon and an oxysulfide phase of ceria may be produced and deposit in the various stages. At various times, the reactor might be purged with air or oxygen so as to oxidize the carbon and sulfur to carbon dioxide and sulfur dioxide to regenerate the catalyst and sorbents. The flow rate and concentration of oxygen is controlled to be low enough that the bed temperature does not exceed 700° C., more preferably 600° C., and more preferably 500° C. during the exothermic oxidation of carbon and sulfur. By using two or more reactors, again a continuous flow of the desired material can be produced by alternatively switching the cycles between the multiple reactors.

The nanoparticulate catalyst materials used in the present invention can be made by a number of methods capable of making the compositions and small size. These methods include but are not limited to sol-gel, plasma vapor deposition (PVD), chemical vapor deposition (CVD), solution precipitation, arc synthesis, and the preferred method of combustion synthesis. The powders used in the examples below were all made using the methodology disclosed in U.S. Pat. No. 5,997,956, where chemicals are put into liquid solutions, atomized to very small droplets and then are grown in a flame to form the submicron and nanopowders. Bag house filters were used to separate the powders from the flame's resulting gas stream.

It can be helpful to pretreat the powders at a temperature close to that which is delineated as the maximum reactor operating condition for at least a few hours. This will minimize further grain growth and shrinkage over time, thus maintaining a more constant operating performance and fluid flow field to the reactor. It may be that nanoparticulates will agglomerate into a porous and permeable solid form during the heat treatment. In fact, this may be desirable. Although the surface area may be lowered slightly by such agglomeration, the reduction in surface area is seldom more than about 10%, and by using nanoparticulates of sufficiently high surface area to begin with, the agglomerated nanoparticulates, still have the requisite surface area to meet the criteria of the present invention. Nanoparticulates may be agglomerated such that the resulting shape and size after heat treatment and agglomeration is idea for use in the reactor. The initial form of the agglomerate is created by dry pressing the nanopowder or by adding a small amount of binder to the nanopowder and then creating a preform agglomerate. The preform agglomerate most invariably shrinks in size during the heat treatment; thus, the initial size of the nanoparticulate mass must be enlarged to account for the shrinkage. The agglomerate can also be formed into pellets or other desired and known forms for use in reactors. Alternatively, the material can be coated onto a base material commonly used in catalyst reactors. Care must be taken to have the surface areas of any agglomerate to be in the ranges described elsewhere herein.

A reactor may also just contain one or two of the layers composed mostly of the described high surface area catalysts so that the primary purpose is just desulfurization or hydrocarbon cracking.

Although micron-sized particulates may be used in parts of the bed or admixed with nanoparticulates, e.g., to enhance permeability, preferably much or all of the material is nanoparticulate.

EXAMPLE 1

A cylindrical multi-stage reactor, in which cracking, desulfurization, and hydrogen reforming take place approximately 2 m. in height, 15 cm. internal diameter was packed in stage 1 with 0.2 kg. of samarium cerium oxide (cracking stage), in stage 2 with 0.5 kg. of cerium oxide (desulfurization/guard bed), in stage 3 with 2 kg. copper cerium oxide (reforming catalyst), and in a stage 4 with 0.5 kg cerium oxide (final desulfurization). The reactor, as measured at the top of stage 3 was brought to 500° C. Into the reactor was introduced 0.1 kg. atomized jet fuel and 0.54 kg. water over a time period of 1 hr. 6 g hydrogen was recovered, representing an efficiency of 35%. Sulfur content in the starting jet fuel ranged from 300-1000 ppm and was reduced to <1 ppm $H_2S$ on the reformer exhaust, while CO content was typically 1000-5000 ppm.

EXAMPLE 2

Our two-step hydrogen generation process in which hydrocarbon fuel decomposes over a catalyst creating an initial defect oxide structure followed by defect replenishment/hydrogen generation step using steam as outlined in equations (III) and (IV). In this process, sulfur and carbon monoxide species may be sequestered in the exhaust stream from the first step. This process, in which methane was used in the first step, was carried out in cylindrical reactor, which was approximately 0.5 m. in height, 22 mm. internal diameter and was packed in a single stage with 5 g. of copper cerium oxide. The reactor, as measured in the center of the powder bed was brought to 500° C. Into the reactor was introduced 0.05 lpm methane fuel for 10 minutes followed by introduction of steam over a time period of 1 hr. 75 mg. hydrogen was recovered with less than 30 ppm CO, representing an efficiency of 64.9%.

EXAMPLE 3

As in example 2, this example outlines our 2-step hydrogen generation process carried out at low temperatures. A cylindrical reactor approximately 0.5 m. in height, 22 mm. internal diameter was packed in stage 1 with 5 g. of copper praseodymium cerium oxide ($Cu_{0.4}Pr_{0.05}Ce_{0.55}O_2$). The reactor, as measured in the center of the powder bed was brought to 300° C. Into the reactor was introduced 0.05 lpm methane fuel for 10 minutes followed by introduction of steam over a time period of 1 hr. 5.1 mg. hydrogen was recovered with less than 30 ppm CO, representing an efficiency of 3.9%.

EXAMPLE 4

This example outlines the same reactor described in example 1, but using methane as the hydrocarbon source thus demonstrating its fuel flexibility. A cylindrical reactor approximately 2 m. in height, 15 cm. internal diameter was packed in stage 1 with 0.2 kg. of samarium cerium oxide, in stage 2 with 0.5 kg. of cerium oxide, in stage 3 with 2 kg. copper cerium oxide, and in a stage 4 with 0.5 kg cerium oxide. The reactor, as measured at the top of stage 3 was brought to 500° C. Into the reactor were introduced 2.4 lpm methane and 9 ml/min. water over a time period of 1 hr. 21.1 g hydrogen was recovered, representing an efficiency of 88% with CO levels between 1000 and 5000 ppm.

EXAMPLE 5

A cylindrical reactor approximately 1 m. in height, 5 cm. internal diameter was packed with 0.5 kg. of cerium oxide. The reactor, as measured at the end of the packed bed was brought to 400 to 500° C. Into the reactor was introduced about 50 g/min propane over a time period of about 1 hr. The propane collected downstream of the bed exhibited S content reduced by over 90% which was used in experiments requiring low sulfur. In this case the propane started as a liquid, was allowed to expand at a heated restriction into gas near the packed bed, and then was cooled after the desulfurizing bed back into liquid with the entire system being maintained above 140 psi.

Various features of the invention are set forth in the following claims.

What is claimed:

1. A method of reducing the sulfur content of a petroleum fluid comprising providing a bed of particulates of catalyst material having the formula $M(1)_xM(2)_{1-x}O_{2-z}$ where M(1) is a transition metal or a rare earth metal, M(2) is a rare earth metal, where M(1) and (M(2) are two different rare earth metals, x is between 0 and about 0.9, and z represents a degree of oxygen deficiency in said catalyst relative to M(1) plus M(2), said particulates having a surface area of at least about 15 $m^2$/gm, and passing said petroleum fluid through said bed of catalyst material at a temperature of about 650° C. or below.

2. The method according to claim 1 wherein said particulates have a surface area of at least about 25 $m^2$/gm.

3. The method according to claim 1 wherein M(2) is cerium or gadolinium.

4. The method according to claim 1 wherein said petroleum fluid through said bed of catalyst material at a temperature of about 500° C. or below.

5. The method according to claim 1 wherein said petroleum fluid through said bed of catalyst material at a temperature of about 400° C. or below.

* * * * *

UNITED STATES PATENT AND TRADEMARK OFFICE

CERTIFICATE OF CORRECTION

PATENT NO. : 7,625,482 B1
APPLICATION NO. : 11/473463
DATED : December 1, 2009
INVENTOR(S) : Hunt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 576 days.

Signed and Sealed this

Second Day of November, 2010

David J. Kappos

David J. Kappos
*Director of the United States Patent and Trademark Office*